US010450753B1

(12) United States Patent
Bliss

(10) Patent No.: US 10,450,753 B1
(45) Date of Patent: Oct. 22, 2019

(54) ENCLOSURE WITH ROOF PANELS RECEIVED IN SUPPORTING CHANNELS

(71) Applicant: DOOSAN FUEL CELL AMERICA, INC., South Windsor, CT (US)

(72) Inventor: Theron Bliss, Broad Brook, CT (US)

(73) Assignee: DOOSAN FUEL CELL AMERICA, INC., South Windsor, CT (US)

( * ) Notice: Subject to any disclaimer, the term of this patent is extended or adjusted under 35 U.S.C. 154(b) by 0 days.

(21) Appl. No.: 16/106,615

(22) Filed: Aug. 21, 2018

(51) Int. Cl.
*E04D 3/38* (2006.01)
*E04D 3/36* (2006.01)
*E04D 3/366* (2006.01)

(52) U.S. Cl.
CPC ..... *E04D 3/38* (2013.01); *E04D 3/3605* (2013.01); *E04D 3/366* (2013.01)

(58) Field of Classification Search
CPC ..... E04D 3/38; E04D 3/66; E04D 3/3605
USPC ..... 52/461
See application file for complete search history.

(56) References Cited

U.S. PATENT DOCUMENTS 2,969,589 A * 1/1961 Fromson ..... B21D 39/03 160/40
3,832,820 A * 9/1974 Eggert ..... F16B 5/0607 52/309.1
3,909,994 A * 10/1975 Richter ..... E04B 1/3211 135/119
4,075,811 A * 2/1978 Keith ..... E04B 7/22 52/395
4,173,101 A 11/1979 Van Wingerden
4,546,586 A * 10/1985 Knudson ..... E04C 2/08 52/469
5,078,530 A * 1/1992 Kim ..... E04D 3/366 403/24
5,197,238 A 3/1993 Peleg
6,260,321 B1 * 7/2001 Rudduck ..... E04B 2/7455 52/281
6,481,911 B1 * 11/2002 Streuber ..... F16B 3/005 403/280
7,365,266 B2 * 4/2008 Heckeroth ..... H01L 31/048 136/244
2006/0000161 A1 * 1/2006 Darmer ..... E04D 3/06 52/200

FOREIGN PATENT DOCUMENTS

CN 203145339 U 8/2013
CN 103741891 A 4/2014
CN 207296121 U 5/2018
(Continued)

*Primary Examiner* — Jeanette E Chapman
(74) *Attorney, Agent, or Firm* — Carlson, Gaskey & Olds

(57) ABSTRACT

An illustrative example enclosure includes a support frame having longitudinal beams and lateral channel members that define an outward facing flow passage. A first roof panel and a second roof panel respectively include lateral edges aligned with the channel members. The lateral edge of the first roof panel is situated adjacent the lateral edge of the second roof panel. An interface between the lateral edge of the first roof panel and the lateral edge of the second roof panel is situated above or within the flow passage of one of the channel members. At least one seal engages the first roof panel and the second roof panel. The seal is received in the flow passage of the channel member in sealing engagement with the channel member.

20 Claims, 4 Drawing Sheets

(56) References Cited

FOREIGN PATENT DOCUMENTS

| | | | | | |
|---|---|---|---|---|---|
| DE | 1658904 | A1 | * | 11/1970 | ..... E04B 1/32 |
| DE | 2016089 | B1 | * | 9/1971 | ..... E04B 7/14 |
| DE | 2361534 | A1 | * | 6/1974 | ..... E04D 3/366 |
| FR | 2508957 | A1 | * | 1/1983 | ..... E04B 7/08 |
| GB | 1068621 | A | * | 5/1967 | ..... E04B 1/6803 |
| JP | H0782845 | A | | 3/1995 | |

* cited by examiner

ENCLOSURE WITH ROOF PANELS RECEIVED IN SUPPORTING CHANNELS

BACKGROUND

Enclosures or covering structures are used for a variety of purposes. For example, fuel cell power plants that include multiple cell stack assemblies and a reformer often have a dedicated structure to protect the power plant components from exposure to the environment. Issues faced by designers of such structures include providing a sufficiently durable and protective structure at a reasonable cost.

SUMMARY

An illustrative example enclosure includes a support frame having a plurality of longitudinal beams and a plurality of lateral channel members that define an outward facing flow passage. A plurality of roof panels includes at least a first roof panel and a second roof panel. The roof panels respectively include first and second lateral edges aligned with the channel members. The first lateral edge of the first roof panel is situated adjacent the second lateral edge of the second roof panel. An interface between the first lateral edge of the first roof panel and the second lateral edge of the second roof panel is situated above or within the flow passage of one of the channel members. At least one seal engages the first roof panel near the first lateral edge of the first roof panel and engages the second roof panel near the second lateral edge of the second roof panel. The seal is received in the flow passage of the channel member in sealing engagement with the channel member.

Various features and advantages of at least one disclosed example embodiment will become apparent to those skilled in the art from the following detailed description. The drawings that accompany the detailed description can be briefly described as follows.

DETAILED DESCRIPTION

Enclosures designed according to an embodiment of this invention are useful for a variety of purposes. An enclosure for a fuel cell power plant is illustrated and used as an example for discussion purposes.

Figure 1:
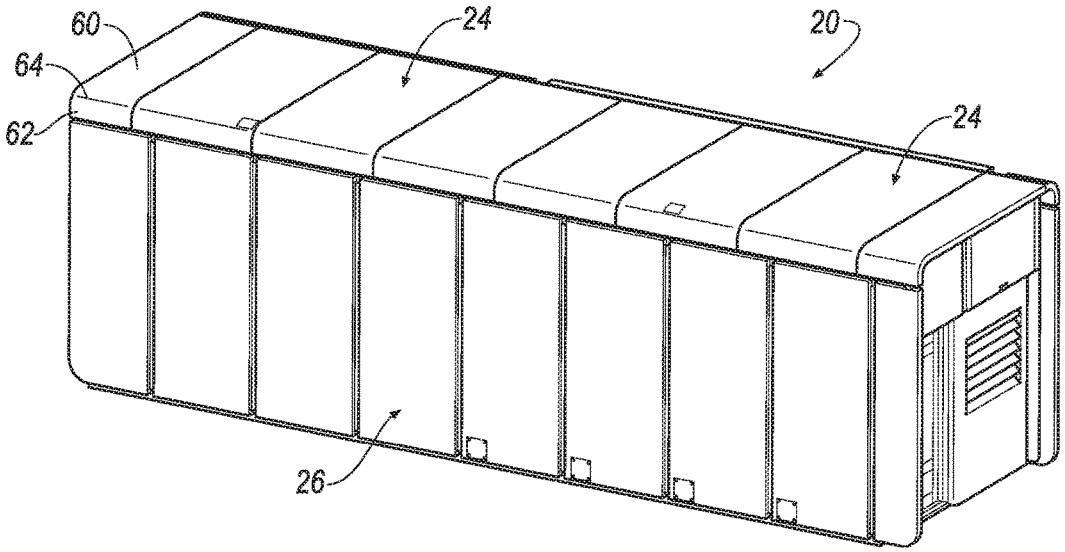
FIG. 1 diagrammatically illustrates an enclosure designed according to an embodiment of this invention that is suitable for housing a fuel cell power plant.
Figure 2:
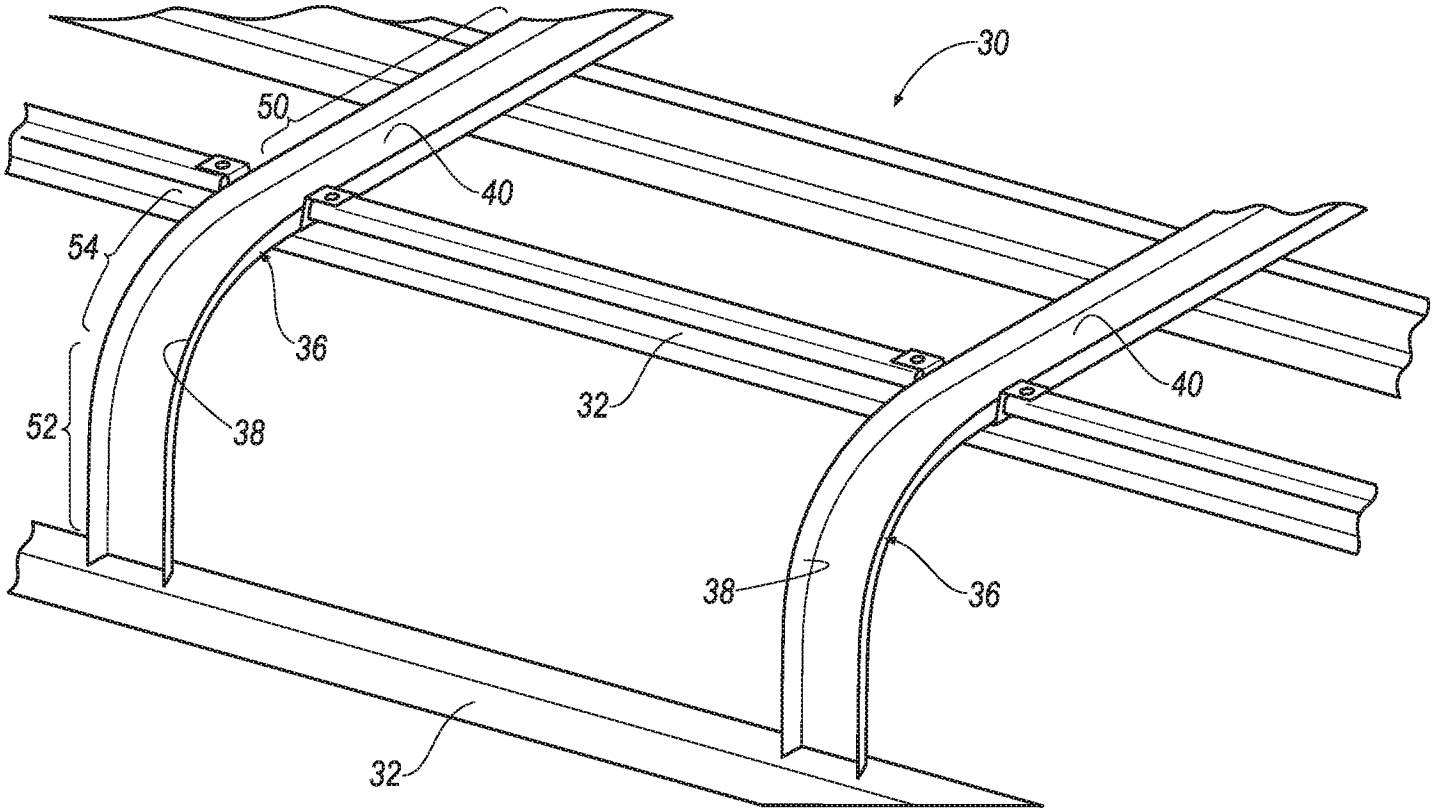
FIG. 2 illustrates a portion of a support frame including channels as part of a roof structure in an example embodiment.

FIG. 1 shows an enclosure 20 that includes a plurality of roof panels 24 and a plurality of side or wall panels 26. As partially shown in FIGS. 2 and 4, the enclosure 20 includes a support frame that includes a plurality of longitudinal beams 32 and 34. In this example, the beams 32 extend along a length of the structure and provide support under the roof panels 24. The longitudinal beams 34 also extend along the length of the structure and provide support under ends of the roof panels 24.

A plurality of channel members 36 are situated generally perpendicular to the longitudinal beams 32, 34. The channel members 36 each include raised edges 38 and define an outward or upward facing flow passage 40. The channel members 36 provide support for the roof panels 24.

The channel members 36 in the illustrated example include a generally flat first portion 50 that is situated along a top of the enclosure 20. A generally flat second portion 52 is situated near an end of each channel member 36. In this embodiment the second portions 52 are generally parallel to the wall panels 26. A curved transition portion 54 extends between the first portion 50 and the second portion 52. As can be seen in FIG. 1, the roof panels 24 include a first flat portion 60, a second flat portion 62 and a curved transition portion 64. The roof panel portions 60, 62 and 64 are aligned with the channel member first flat portion 50, second flat portion 52 and curved transition portion 54, respectively, when the roof panels 24 are situated on the channel members 36.

Figure 5:
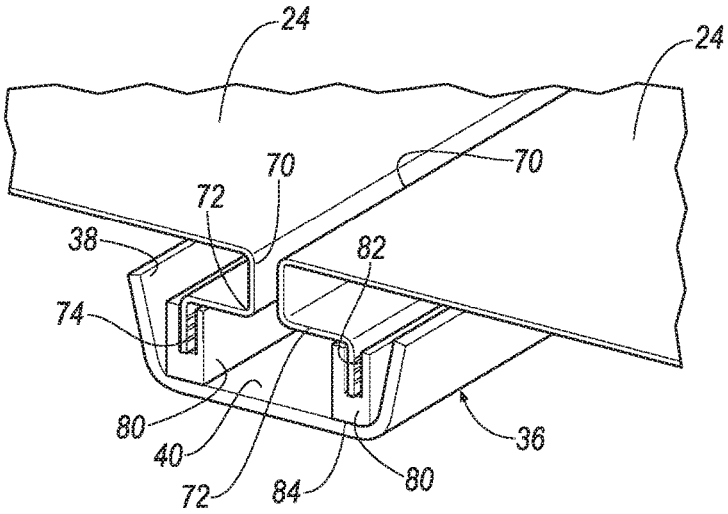
FIG. 5 illustrates a sealing feature of an example embodiment.
Figure 3:
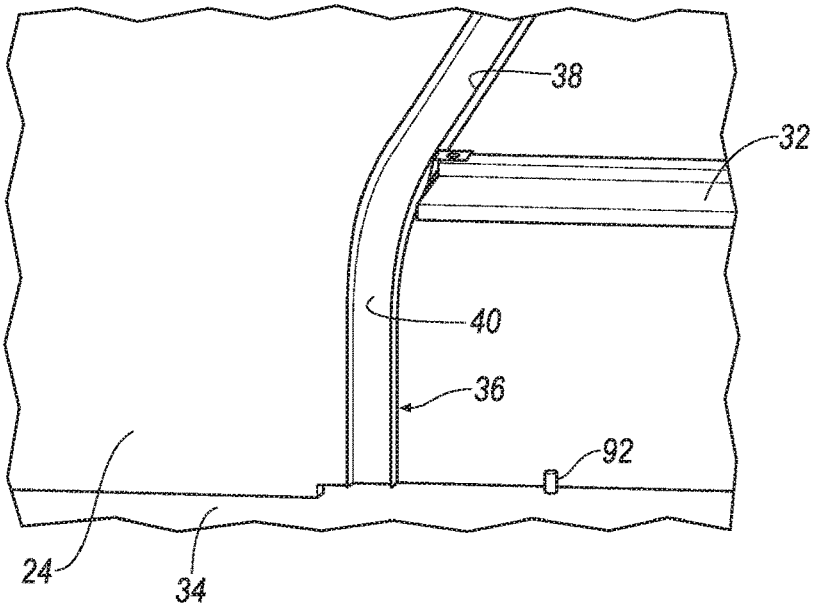
FIG. 3 illustrates a roof panel received in one of the channels shown in FIG. 2 from a first perspective above the roof panel.
Figure 4:
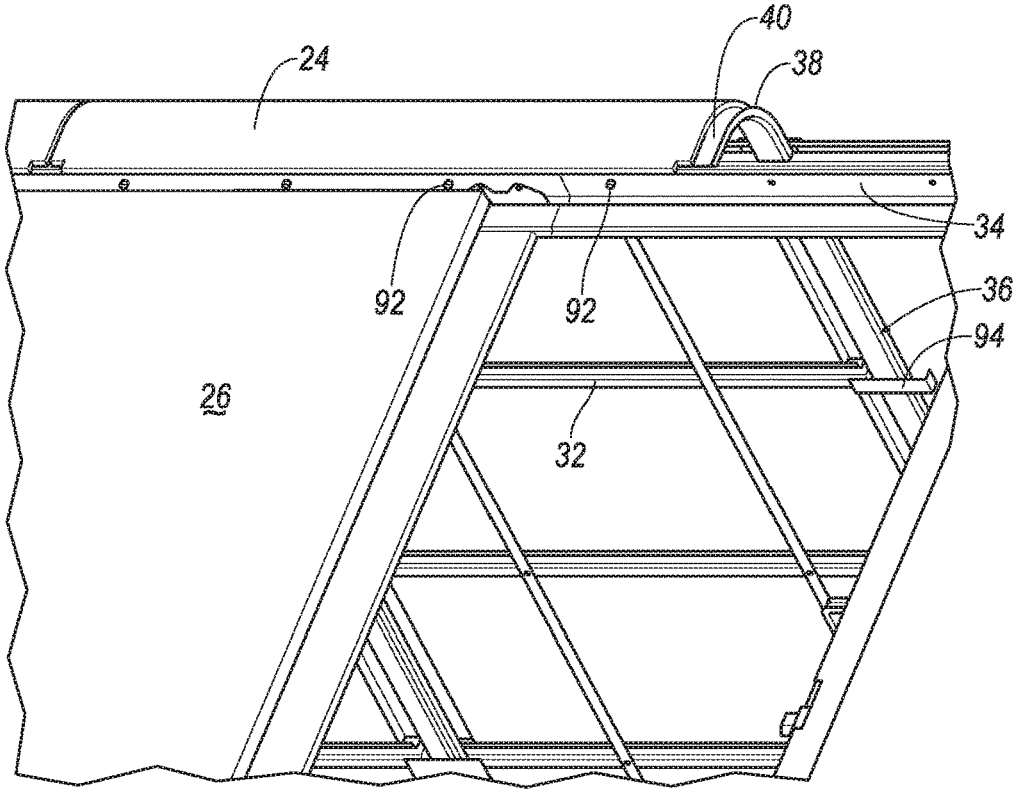
FIG. 4 illustrates the roof panel shown in FIG. 3 from a second, different perspective beneath the roof panel.

Referring to FIGS. 3, 4 and 5, the roof panels 24 include lateral edges 70 that are situated above or in the flow passage 40 of the channel members 36. Any water or moisture on a roof panel 24 may run off the roof panel and into the flow passage 40 of a corresponding one of the channel members 36. The roof panels 24 include respective folded segments 72 near the lateral edges 70. The folded segments 72 establish a drip edge along the lateral edge 70. The folded segments terminate at an end 74 of the corresponding roof panel 24.

The ends 74 of the roof panels 24 are at least partially received by a seal 80. In this example each end 74 near each lateral edge 70 of each roof panel 24 has a corresponding seal 80. In this example, each seal 80 includes a seal channel 82 that receives the end 74 of a corresponding roof panel 24. A sealing surface 84 that faces in an opposite direction from the seal channel 82 rests against the channel member 36 and establishes a seal against the flow passage 40 such that any water or moisture entering the flow passage 40 can flow through the passage 40 between the seals 80 and out of the flow passage 40 along a side of the enclosure 20. Example seals 80 comprise a polymer material such as an elastomer or rubber.

The lateral edges 70 of adjacent roof panels 24 are spaced apart a distance that is less than a distance between their respective ends 74. The seals 80 are also spaced apart a larger distance than the gap between the lateral edges 70. In this example, the ends 74 are situated closer to a middle or center of the respective roof panels 24 than the lateral edges.

The channel members 36 support the weight of the roof panels 24. The example enclosure includes features that secure the roof panels 24 in place. Fasteners 92, such as bolts, are received through the longitudinal beams 34 and an underside of a flap or lip along an edge of the roof panels 24. The fasteners 92 are situated beneath the roof panels 24 and not exposed to the elements.

The illustrated embodiment also includes connectors 94, such as clips, that secure the roof panels to the channel members 36. In this example, the connectors 94 are received underneath respective channel members 36 and have ends that engage the folded segments 72 of respective roof panels 24 to hold the roof panels down against the respective channel members 36.

The example configuration of fasteners 92 and connectors 94 does not require any exposed fasteners or holes along the entire exterior surface of the roof panels 24. The exterior surfaces of the roof panels 24 are continuous and uninterrupted along their entire width and length. This configuration eliminates any holes or interfaces where water could potentially penetrate and seep into the enclosure 20.

Figure 6:
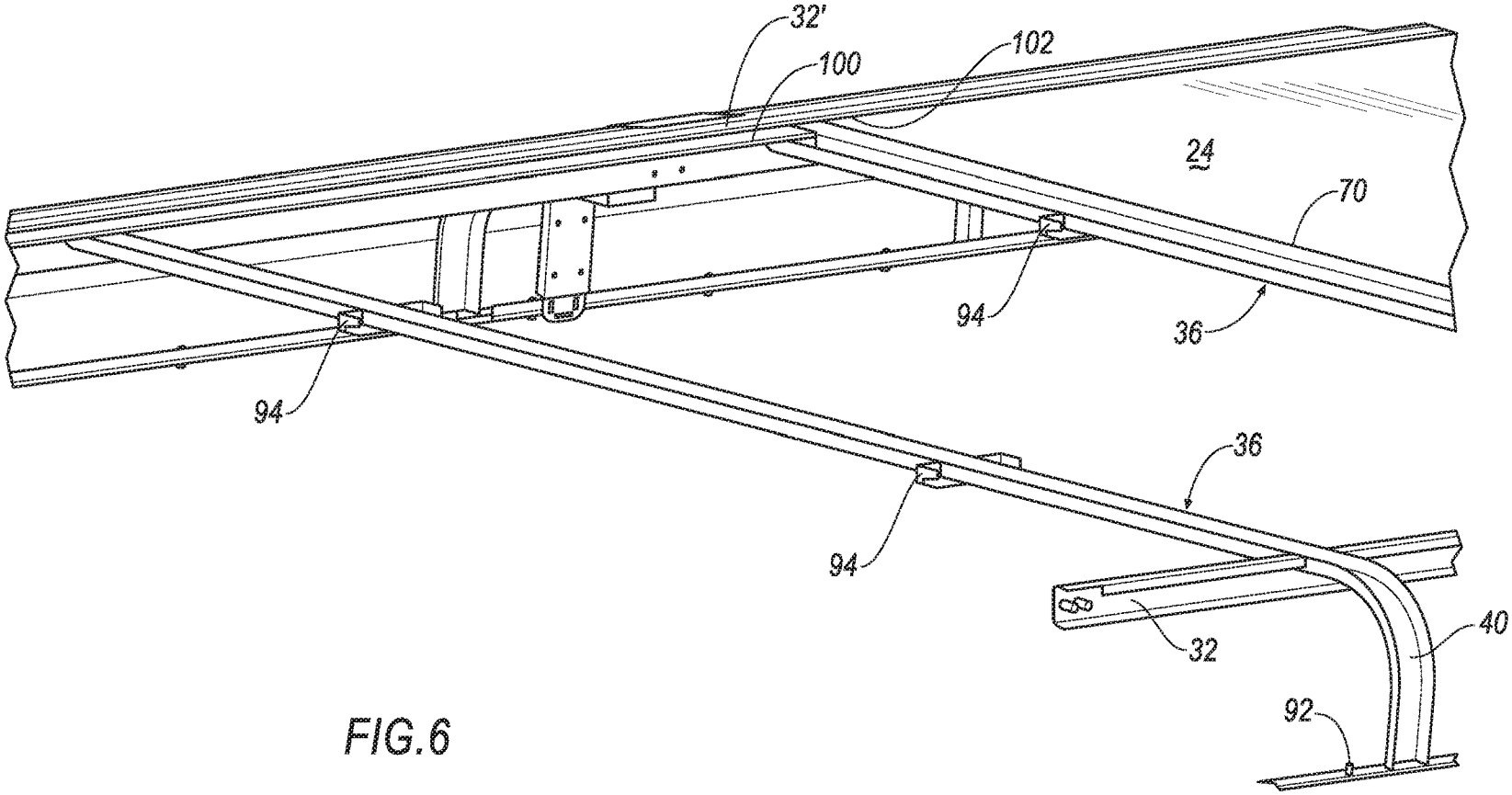
FIG. 6 illustrates a feature of another example embodiment.

In some embodiments, opposite edges of the roof panels are situated along or against longitudinal beams 34 on opposite sides of the structure. In other embodiments, roof panels 24 have one edge situated on the top of the structure 20 and an opposite edge situated along one of the longitudinal beams 34. FIG. 6 illustrates one example arrangement for securing the one edge situated on the top of the structure. In this example, one of the longitudinal beams 32' includes a recess or groove 100 that receives an edge 102 on the roof panel 24. The recess or groove 100 leaves a portion of the longitudinal beam over the edge 102 on the roof panel 24 so that there is no risk of water or moisture entry along the interface between the beam 32' and the roof panel 24. In some embodiments a seal or a bead of sealant may be provided in the groove 100 for additional protection against leaks. This is another embodiment that includes a continuous and uninterrupted surface along the entire exterior of the roof panels 24, which significantly reduces or entirely eliminates any possibility for leaks through the roof of the enclosure 20.

Embodiments such as the disclosed example described above provide a cost-effective way of providing an enclosure or protective structure that has a secure roof that is not subject to potential leaks. The way in which the roof panels are supported by the channel members including at least one seal in the flow passages of the channel members provides a stable support system that controls water flow from the roof of the enclosure in a cost effective manner.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

I claim:

1. An enclosure, comprising:

a support frame including a plurality of longitudinal beams and a plurality of lateral channel members, wherein the channel members define an outward facing flow passage that is at least partially open and exposed from outside the enclosure;

a plurality of roof panels including at least a first roof panel and a second roof panel, the roof panels respectively including first and second lateral edges aligned with the channel members, the first lateral edge of the first roof panel being situated adjacent the second lateral edge of the second roof panel, an interface between the first lateral edge of the first roof panel and the second lateral edge of the second roof panel being situated above or within the flow passage of one of the channel members; and at least one seal engaging the first roof panel near the first lateral edge of the first roof panel and engaging the second roof panel near the second lateral edge of the second roof panel, the at least one seal being received in the flow passage of the one of the channel members in sealing engagement with the one of the channel members.

2. The enclosure of claim 1, wherein the at least one seal comprises a first seal and a second seal;

the first seal is received on an end of the first roof panel; and the second seal is received on an end of the second roof panel.

3. The enclosure of claim 2, wherein the first seal includes a first seal channel;

the end of the first roof panel is received in the first seal channel;

the second seal includes a second seal channel; and the end of the second roof panel is received in the second seal channel.

4. The enclosure of claim 3, wherein the first seal includes a first sealing surface facing in an opposite direction from the first seal channel;

the second seal includes a second sealing surface facing in an opposite direction from the second seal channel;

the first sealing surface is received against the one of the channel members to seal an interface between the first seal and the flow passage of the one of the channel members; and the second sealing surface is received against the one of the channel members to seal an interface between the second seal and the flow passage of the one of the channel members.

5. The enclosure of claim 4, wherein the first seal and the second seal define an area within the flow passage of the one of the channel members through which fluid draining from at least one of the first roof panel and the second roof panel may flow.

6. The enclosure of claim 2, wherein the first lateral edge of the first roof panel includes a folded segment of the first roof panel;

the folded segment defines an outside of the first lateral edge; and the first seal is situated closer to a center of the first roof panel than the outside of the first lateral edge.

7. The enclosure of claim 2, wherein the first and second lateral edge of the roof panels each include a drip edge; and a spacing between the drip edge of the first lateral edge of the first roof panel and the drip edge of the second lateral edge of the second roof panel is smaller than a spacing between the first seal and the second seal.

8. The enclosure of claim 1, wherein each lateral edge includes a drip edge.

9. The enclosure of claim 1, comprising a plurality of connectors that secure the roof panels in respective set positions above the channel members, the connectors engaging at least one interior surface of the roof panels.

10. The enclosure of claim 9, wherein the roof panels each have an exposed exterior surface; and the exposed exterior surfaces are uninterrupted along an entire width and length of the exposed exterior surface.

11. The enclosure of claim 9, wherein the connectors comprise clips respectively received over a portion of the one of the channel members and at least one of the first roof panel and the second roof panel.

12. The enclosure of claim 1, wherein the channel members respectively include a flat first portion along a top of the enclosure;

the channel members respectively include a flat second portion along a side of the enclosure; and the channel members respectively include a curved transition between the first portion and the second portion.

13. The enclosure of claim 12, wherein the roof panels respectively include a first panel portion aligned with the first portion of corresponding ones of the channel members;

the roof panels respectively include a second panel portion aligned with the second portion of the corresponding ones of the channel members; and the roof panels respectively include a curved transition panel portion between the first panel portion and the second panel portion.

14. The enclosure of claim 1, wherein the channel members support a weight of the roof panels.

15. The enclosure of claim 1, comprising at least one retainer plate and wherein the roof panels respectively include a first longitudinal edge that is transverse to the first and second lateral edges; and the first longitudinal edges are secured in place on the enclosure by the at least one retainer plate.

16. The enclosure of claim 1, wherein the first lateral edge of the first roof panel includes a folded segment of the first roof panel;

the folded segment defines an outside of the first lateral edge;

an end of the first roof panel is received by the at least one seal; and the end of the first roof panel is situated closer to a center of the first roof panel than the outside of the first lateral edge.

17. An enclosure, comprising:

a support frame including a plurality of longitudinal beams and a plurality of lateral channel members, wherein the channel members define an outward facing flow passage;

a plurality of roof panels including at least a first roof panel and a second roof panel, the roof panels respectively including first and second lateral edges aligned with the channel members, the first lateral edge of the first roof panel being situated adjacent the second lateral edge of the second roof panel, an interface between the first lateral edge of the first roof panel and the second lateral edge of the second roof panel being situated above or within the flow passage of one of the channel members; and at least one seal engaging the first roof panel near the first lateral edge of the first roof panel and engaging the second roof panel near the second lateral edge of the second roof panel, the at least one seal being received in the flow passage of the one of the channel members in sealing engagement with the one of the channel members;

wherein the at least one seal comprises a first seal and a second seal;

the first seal is received on an end of the first roof panel;

the second seal is received on an end of the second roof panel;

the first and second lateral edge of the roof panels each include a drip edge; and a spacing between the drip edge of the first lateral edge of the first roof panel and the drip edge of the second lateral edge of the second roof panel is smaller than a spacing between the first seal and the second seal.

18. An enclosure, comprising:

a support frame including a plurality of longitudinal beams and a plurality of lateral channel members, wherein the channel members define an outward facing flow passage;

a plurality of roof panels including at least a first roof panel and a second roof panel, the roof panels respectively including first and second lateral edges aligned with the channel members, the first lateral edge of the first roof panel being situated adjacent the second lateral edge of the second roof panel, an interface between the first lateral edge of the first roof panel and the second lateral edge of the second roof panel being situated above or within the flow passage of one of the channel members;

at least one seal engaging the first roof panel near the first lateral edge of the first roof panel and engaging the second roof panel near the second lateral edge of the second roof panel, the at least one seal being received in the flow passage of the one of the channel members in sealing engagement with the one of the channel members; and a plurality of connectors that secure the roof panels in respective set positions above the channel members, the connectors engaging at least one interior surface of the roof panels.

19. The enclosure of claim 18, wherein the roof panels each have an exposed exterior surface; and the exposed exterior surfaces are uninterrupted along an entire width and length of the exposed exterior surface.

20. The enclosure of claim 18, wherein the connectors comprise clips respectively received over a portion of the one of the channel members and at least one of the first roof panel and the second roof panel.

* * * * *